United States Patent [19]

De'Ath

[11] Patent Number: 4,606,256

[45] Date of Patent: Aug. 19, 1986

[54] SIGHT SYSTEM FOR A STABILIZED GUN

[75] Inventor: Mervyn C. De'Ath, Pulborough, England

[73] Assignee: The Marconi Company Limited, England

[21] Appl. No.: 957,311

[22] Filed: Oct. 24, 1978

[30] Foreign Application Priority Data

Nov. 1, 1977 [GB] United Kingdom ..... 45428/77

[51] Int. Cl.[4] ..... F41G 3/22

[52] U.S. Cl. ..... 89/41.09; 89/41.06; 89/41.19

[58] Field of Search ..... 89/41 E, 41 EA, 41 AA, 89/41 LE, 41 CE, 41.04, 41.09, 41.19, 41.21, 41.22

[56] References Cited

U.S. PATENT DOCUMENTS 3,997,762 12/1976 Ritchie et al. ..... 89/41 E

*Primary Examiner*—Stephen C. Bentley

*Attorney, Agent, or Firm*—Kirschstein, Kirschstein, Ottinger & Israel

[57] ABSTRACT

A tank gun sighting system in which there is a visual sight having a boresight mark permanently aligned with the gun and in which an electronic aiming mark is superimposed on the visual target scene. The aiming mark is controllable by the gunner with effectively zero inertia and can be laid on the target very quickly. The gun control equipment is directed by a signal which is the difference between the aiming mark off-boresight signal and the gun movement signal derived from a rate gyro in the gun control loop. The aiming mark is thus stabilized on the target scene, and in particular on the target, as the gun slews round to reduce the boresight/aiming mark error.

An aim-off signal is calculated and added in to the gun control to lay the gun at the required angle off the aiming mark.

13 Claims, 1 Drawing Figure

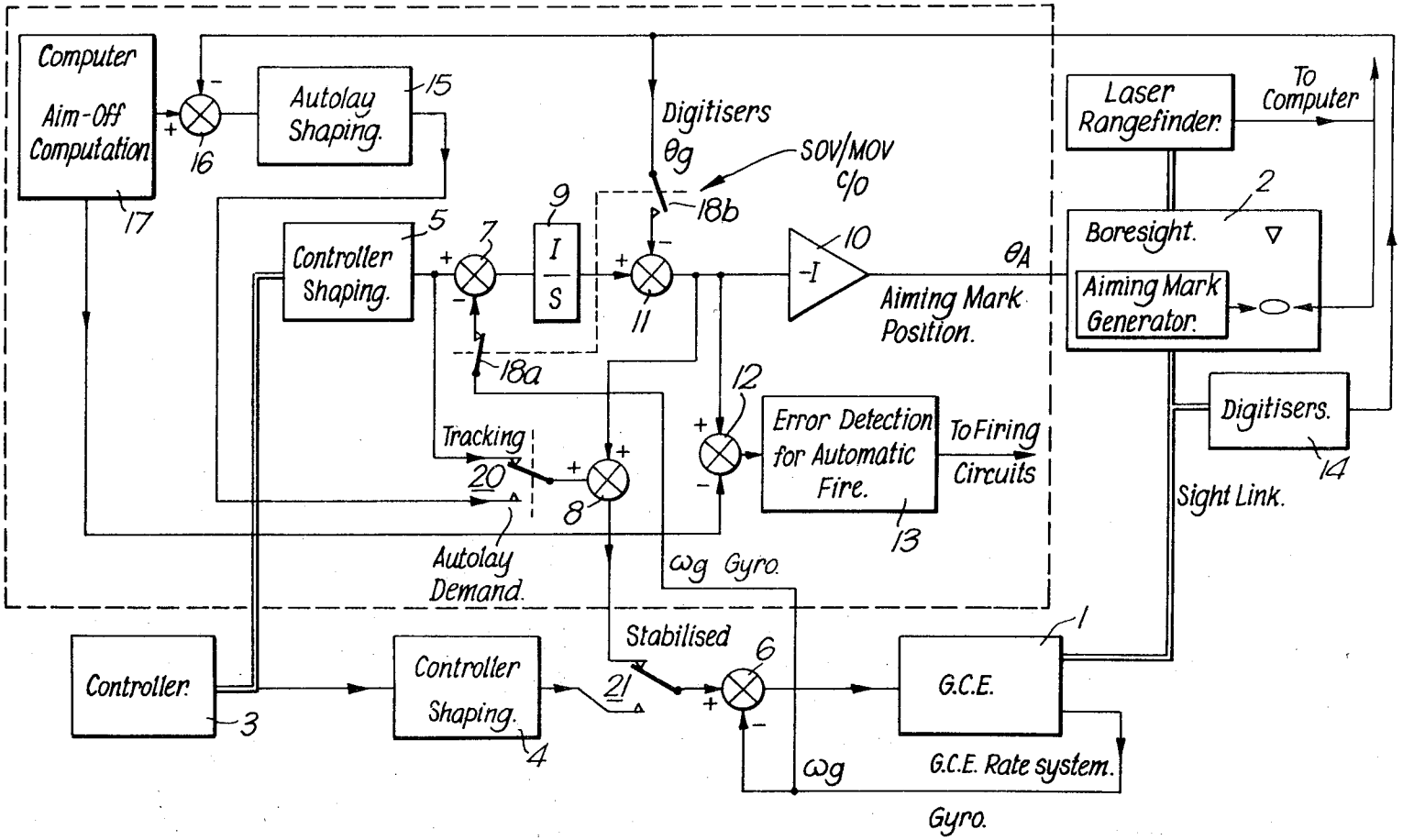
To Computer
Laser Rangefinder.
Boresight.
Aiming Mark Generator.
Digitisers.
Sight Link.
G.C.E.
G.C.E. Rate system.
Gyro.
Aiming Mark Position.
To Firing Circuits
Error Detection for Automatic Fire.
SOV/MOV c/o
Digitisers
Stabilised
Tracking
Autolay Demand.
Controller Shaping.
Autolay Shaping.
Controller Shaping.
Controller.
Computer Aim-Off Computation

SIGHT SYSTEM FOR A STABILIZED GUN

The invention relates to a sight system for a stabilised gun and particularly, although not exclusively, to such a system for a tank mounted gun.

In a known system of gun control in tanks, the gun is steered by servo control in response to the gunner's manipulation of a pick off which he controls by thumb movement. An output signal is derived from the displacement of the pick off from a zero position, the output signal specifying a desired slew rate and direction of the gun. The gun control equipment includes a rate gyro fixedly mounted to the gun and a feedback loop tending to maintain the gun steady in space in the absence of a thumb control input.

In battle conditions there are many factors which require the gun boresight, i.e. the muzzle axis, to be offset from the target. The main factor is, of course, range, but in addition there is target velocity, own vehicle velocity, ammunition type, muzzle velocity, weather conditions etc. In the known system the extent of 'aim-off' is calculated by a computer from information derived from sensors, from a laser range-finder, and from target/own vehicle information derived from tracking the target with the muzzle boresight mark in a sight mechanically linked to the gun.

This latter may be an inverted triangle displayed in the sight, the lower apex of which triangle defines the muzzle boresight (MBS).

When the aim-off information has been calculated, an aiming mark projected into the sight field of view is offset from the muzzle boresight by a predetermined amount. This offset is initiated by the gunner on operation of an 'auto-lay' button. At the same time as the aiming mark is offset, the same offset information is applied to the gun control equipment which immediately starts to steer the gun in such a direction as to take the MBS mark off the target and the aiming mark onto it.

The gun does, of course, have considerable inertia and a short time elapses before the aiming mark is lined-up on the target. The gun is then fired.

In the above procedure there are three kinds of error which affect the firing accuracy. The first is translation error resulting from movement of the target and movement of the 'own vehicle'. With translational movement of either or both vehicles, tracking of the target vehicle is necessary since the basic gun stabilisation will only maintain a constant boresight angle in space. The translation error is then due to the gun inertia and the consequent imperfection of the gunner's tracking.

The second kind of error is basic stabilisation imperfection in that because of the inertia of the gun and the limited power available, even the angle in space is not maintained absolutely constant with vibratory movement of the own vehicle. The gunner will therefore see a random position error of the MBS sight line about the target. He will naturally attempt to correct for this but the reaction time of the human operator introduces time delays into the control loop which can result in the gunner's efforts to correct for bad stabilisation in fact making the position worse.

The third kind of error is that due to gyro datum shifts and other system offsets. These errors are largely time invarient and not a particular problem to the gunner since they are generally small compared to the translation errors.

An object of the present invention is to reduce errors arising from the above stabilisation difficulties, at least in so far as providing a very low inertia gunner-controlled aiming mark and preferably also in stabilising this aiming mark against own vehicle vibration.

According to the present invention, therefore, a sight system for a stabilised gun includes a boresight mark for permanent alignment with the gun boresight, means for injecting an electronically generated aiming mark into the sight, manually operable means for producing a demand signal designating required movement of the aiming mark with respect to the boresight, and means for subtracting from said demand signal a gun movement signal, the arrangement being such that the aiming mark is controlled with respect to the target scene in accordance with the demand signal and irrespective to the rate of gun movement.

Preferably the sight system is for use in a moving-own-vehicle (MOV) situation, it then includes means for integrating a rate gyro signal of the gun stabilising system to constitute said gun movement signal.

Where it is for use in a stationary-own-vehicle (SOV) situation, it may include means for deriving said gun movement signal directly from the gun disposition.

Preferbly the sight system is adapted for both situations, it then incorporating switching means for selecting the appropriate gun movement signal according to the situation, MOV or SOV.

Where the demand signal and the gun movement signal constitute components of a gun control signal, a further component may consist of a signal representative of the displacement between the boresight mark and the aiming mark.

The sight system may include an autolay facility which comprises means for calculating the required aim-off of the gun in response to target movement and factors affecting the fall of the shot and means for substituting a signal representative of said aim-off for said demand signal as a component of said gun control signal, the gun movement signal resulting from the substituted autolay aim-off signal causing the aiming mark to remain in position on the target scene as the boresight mark moves to the aim-off position. In this case there may be means for comparing the calculated aim-off with the displacement of the boresight mark and initiating a firing signal when the comparison shows equality.

One embodiment of a sight system for a stabilised gun will now be described, by way of example, with reference to the accompanying drawing showing a block diagram of the sight system.

The gun is controlled by gun control equipment 1 comprising servo-control and power amplifier equipment in known manner. The gun moves in response to a gun control signal derived from a summing circuit 6. Mounted on the gun or in fixed relation with it is a rate gyro (included in the GCE block 1) producing a gun movement signal proportional to the slew rate (i.e. angular velocity) of the gun movement. This gun movement signal is applied to a subtracting input of the summing circuit 6 as one component of the gun control signal.

Mechanically fixed to the gun is a sight 2 through which the target scene is viewed. This sight incorporates a fixed muzzle boresight mark (MBS) which may be the apex of an inverted triangle. As its name implies, this mark is permanently aligned with the boresight or muzzle axis. In addition to this fixed mark the sight 2 includes cathode ray tube means for injecting an aiming mark onto the target scene, the position of the injected aiming mark being controllable with respect to the centre of the scene, i.e. with respect to the boresight mark.

The CRT circuitry includes a facility for generating two kinds of aiming mark. The first is purely for the marking of a spot on the screen and consists of electronic cross wires or something similar, in known manner. The second form which, as will be explained, is generated following a range determination, consists of an ellipse with its major axis horizontal and of size dictated by the range signal and varying inversely with the range. The size of the ellipse is then set such that for a typical target, i.e. a tank, the ellipse just encloses the view of the tank at all ranges. The circuitry necessary to achieve this is obvious once the concept is stated.

Both the gun and the position of the aiming mark are controlled by a manual controller 3 which is in the form of a thumb operated position pick-off. This has a centre zero position and, at positions displaced from zero, gives a signal proportional to the displacement in magnitude and direction. This signal is required to specify, and in fact demand, a rate of angular movement of both gun and aiming mark. A shaping circuit 5 provides the desired characteristic for this demand signal for both gun control and aiming mark control in operation according to the invention.

If the stabilised sighting system fails or is not required for any reason, a switch 21 may be operated, away from the position shown, to feed the controller signal directly to the summing circuit 6. In this case the demand signal is shaped by a circuit 4.

The demand signal from the shaping circuit 5 is applied to the summing circuit 6 by way of a switch 20, shown in a 'tracking' position, a summing circuit 8, and the switch 21 in its 'stabilised' position. In addition, the demand signal, which, it will be recalled, specifies angular 'rate', is applied to an integrator circuit 9 whose output is therefore a signal increasing with time and specifying angular displacement. This will of course increase linearly with time if the rate demand from the thumb controller is held constant.

After integration the demand signal is inverted, as will be explained, and applied to the sight 2 to determine the displacement of the electronically generated aiming mark.

As can be seen from the drawing, the demand signal is not the only signal determining the aiming mark displacement. There is in addition the gun movement signal constituting the feedback signal in the gun control loop. When a switch 18(*a*) is in the closed position shown, this gun movement signal is subtracted from the demand signal in a summing circuit 7 and it is in fact the resulting difference signal which is integrated in the integrator 9. The switch 18(*a*) is closed in a moving-own-vehicle (MOV) situation and opened in a stationary-own-vehicle (SOV) situation. A further switch 18(*b*) is ganged to it but opens and closes in a reverse manner. The switch 18(*b*) applies a signal from digitisers 14 giving a direct representation of the gun attitude. It may be seen therefore that according to the situation MOV or SOV, either a rate signal is subtracted from the demand signal before integration, or a direct angle signal is subtracted from the demand signal (in a summing circuit 11) after integration of the demand signal.

The output of the summing circuit 11 is a signal indicating, and in fact producing, the displacement between the injected aiming mark and the MBS mark. This signal is, in effect, compared with a calculated aim-off signal in a summing circuit 12 to produce a firing signal when equality is obtained. It is also applied to a summing circuit 8 to constitute a third component in the gun control signal applied to the equipment 1.

The demand signal component of the gun control signal can be replaced by a calculated aim-off signal by operation of a changeover switch 20 in an autolay operation as will be explained. The required aim-off signal is calculated by a computer supplied with information on the main factors affecting the fall of the shot, that is, the target range, type of charge, muzzle velocity, weather conditions, target velocity relative to own vehicle and so on. This gives the aim-off in terms of the required boresight direction with respect to a reference plane. When this autolay facility is employed the boresight will in fact be lined up on the target. The net autolay demand signal is then the calculated aim-off angle (referred to the reference plane) minus the actual boresight angle. The latter is obtained from the digitisers 14 mounted on the gun and giving a continuous indication of the boresight direction relative to the reference plane.

Having now described the various components of the system and, briefly, the way they operate, the overall operation will now be described.

Assume that all the switches are in the conditions shown, that is, a moving-own-vehicle, stabilised-operation situation.

The thumb controller 3 will be in its zero position giving no output signal.

When a target, another tank suppose, comes into the sight, the gunner operates his thumb controller to steer the aiming mark appropriately. The demand signal is supplied by way of the shaping circuit 5, switch 20, summing circuit 8, switch 21 and summing circuit 6. The gun movement signal supplied by the rate gyro of the control equipment 1 reduces the demand signal in accordance with the loop gain of the gun control servo loop to leave a net gun control signal. The gun therefore slews round at a corresponding angular velocity.

At the same time the demand signal is integrated by the integrator 9 to produce a signal representative of an angle increasing linearly with time if the demand rate is held constant. Since the original demand signal is with respect to the MBS mark, the integrated signal would make the injected aiming mark depart from the MBS at the rate that it should be departing from its original target position. Since the MBS is also departing from this same original target position but at a rate determined by the gun inertia, the departure rate of the aiming mark would be too great and a correcting signal representative of the gun movement is subtracted from the demand signal in summing circuit 7. In an MOV situation the gun movement signal is, for a reason to be explained, the gyro-rate signal, and this therefore has to be integrated to provide a signal representative to the angle of gun movement. Hence the gyro rate signal is subtracted from the demand signal before the integrator 9.

It may therefore be seen that the injected aiming mark moves across the target scene under the direct control of the thumb controller irrespective of the actual gun slew rate. Since there is no inertia associated with the injected aiming mark, unlike the MBS, the gunner can lay it on a target very rapidly. The gun control equipment 1 then makes the gun, and thus the MBS, follow the injected aiming mark to tend to eliminate the displacement between them.

Thus the main object of the invention is achieved in providing an instantly controllable aiming mark, i.e. one with substantially infinite bandwidth control, which is followed automatically by the gun.

A further feature of the invention concerns the control of the aiming mark so that it can be locked onto a target without vibrating with the random movements of the own vehicle. This does of course only apply to the MOV situation. In this case, the gun control equipment can never be sufficiently effective to maintain the gun angle in space perfectly. However, the resulting unstabilised movement of the gun is sensed by the rate gyro, integrated, inverted by the amplifier 10 and applied to the aiming mark control. It is thus exactly in opposition to the movement imposed on the sight, and on the aiming mark, by the remaining instability of the gun and effectively locks the injected aiming mark to the target scene.

Clearly, in an SOV situations there is no random movement of the gun and no need to use the rate gyro to sense it. The simpler and more direct reading digitisers 14 can then be used, by way of the switch 18(*b*) to indicate the gun angle and relate the aiming mark to the target scene rather than the MBS.

To continue with the operation, the gunner will reduce the thumb controller output as the aiming mark approaches the target, reducing it to zero as he lays it on the target. Since the aiming mark can be laid on the target very much more quickly than the gun and boresight mark, the demand has to be maintained, holding the aiming mark on target until the MBS has caught up with it. At this stage the output signal from the summing circuit 11 represents the displacement between the aiming mark and the MBS and is used as an additional component of the gun control signal, by way of summing circuits 8 and 6. This component will of course fall to zero as the MBS is brought into coincidence with the aiming mark.

When the MBS and aiming mark coincide on the target the laser rangefinder is triggered, either manually or automatically as the circuit 11 output falls to zero, and, in response to the calculated range, the aiming mark is modified to form an ellipse adjusted in size so as just to embrace the image of a tank at the calculated distance. The 'fit' of the ellipse on the target gives a confirmation of the range determination.

Tracking of the target proceeds under the gunner's operation of the tumb controller for a short time, up to one second, say. Tracking information will also have been available before the MBS caught up with the aiming mark, since the aiming mark location, and thus the target location was known from the MBS position (digitiser 14 output) and the output signal of summing circuit 11.

The tracking period is thus brought forward relative to what is possible in the known system where tracking can only commence when the MBS is 'on target'.

When a sufficient tracking period has elapsed to obtain the necessary air-off information, the 'autolay' switch 20 is operated. The aim-off demand signal from the computer is then substituted for the normal demand signal, which, at this stage will be due only to the tracking operation. The aim-off demand is applied to the gun control but not to the aiming mark directly, the latter being still subject to the tumb controller through the integrator 9. However, if the thumb controller output is zero, the aiming mark is being controlled by the gun movement signal (from the gun gyro) through the integrator 9. (Alternatively, by the digitiser output signal in an SOV situation). The aiming mark will therefore be driven off the MBS in the opposite direction from the desired aim-off and exactly in accordance with the movement of the gun to the aim-off position. Thus the aiming mark will in fact remain on the target while the MBS moves to the aim off position.

During this movement of the MBS relative to the aiming mark and the target, the signal output from the summing circuit 11 is increasing towards the aim-off value at which point the gun and MBS would stop moving. The circuit 11 output is therefore subtracted from the calculated aim-off value in summing circuit 12 and when the difference is zero, indicating equality of the inputs, a trigger signal is derived by circuit 13 to fire the gun. The gunner has therefore only to keep his finger on the firing button after triggering 'autolay' and the gun will fire automatically when in the correct position.

I claim:

1. A sight system for a stabilised gun, the sight system including a boresight mark for permanent alignment with the gun boresight, means for injecting an electronically generated aiming mark into the sight, manually operable means for producing a demand signal designating required movement of the aiming mark with respect to the boresight, and means for subtracting from said demand signal a gun movement signal, the arrangement being such that the aiming mark is controlled with respect to the target scene in accordance with the demand signal and irrespective of the rate of gun movement.

2. A sight system according to claim 1, for use in a moving-own-vehicle (MOV) situation, and including means for integrating a rate gyro signal of the gun stabilising system to constitute said gun movement signal.

3. A sight system according to claim 1, for use in a stationary-own-vehicle (SOV) situation, and including means for deriving said gun movement signal directly from the gun disposition.

4. A sight system according to claim 2, and incorporating switching means for selecting the appropriate gun movement signal according to the situation, MOV or SOV.

5. A sight system accoding to claim 1, 2, 3, or 4, in which said demand signal and said gun movement signal constitute components of a gun control signal and wherein a further component consists of a signal representative of the displacement between said boresight mark and said aiming mark.

6. A sight system according to claim 5, including an autolay facility which comprises means for calculating the required aim-off of the gun in response to target movement and factors affecting the fall of the shot and means for substituting a signal representative of said aim-off for said demand signal as a component of said gun control signal, the gun movement signal resulting from the substituted autolay aim-off signal causing the aiming mark to remain in position on the target scene as the boresight mark moves to the aim-off position.

7. A sight system according to claim 6, including means for comparing the calculated aim-off with the displacement of the boresight mark and initiating a firing signal when the comparison shows equality.

8. A sight system according to claim 1 including means responsive to alignment of the boresight with the aiming mark to initiate operation of a rangefinder, the system including means for generating an aiming mark with a magnitude inversely proportional to the target range.

9. A sight system according to claim 8, wherein said aiming mark is in the form of an enclosure of standard form such as just to enclose the view of a standard target at all ranges.

10. A sight system according to claim 8 or claim 9, wherein said aiming mark is in the form of an ellipse, said standard target being a military tank.

11. A sight system according to claim 1 for use in both moving-own-vehicle (MOV) and stationary-own-vechicle (SOV) situations, said system including means for integrating a rate gyro signal of the gun stabilizing system to constitute said gun movement signal, means for deriving said gun movement signal directly from the gun disposition, and switching means for selecting the appropriate gun movement signal according to the situation MOV or SOV.

12. A sight system according to claim 3 and incorporating switching means for selecting the appropriate gun movement signal according to the situation, MOV or SOV.

13. A sight system according to claim 12 in which said demand signal and said gun movement signal constitute components of a gun control signal and wherein a further component consists of a signal representative of the displacement between said bore sight mark and said aiming mark.

* * * * *